US010626742B2

(12) United States Patent
Albers et al.

(10) Patent No.: US 10,626,742 B2
(45) Date of Patent: Apr. 21, 2020

(54) INNER RING AND GUIDE VANE CASCADE FOR A TURBOMACHINE

(71) Applicant: MTU Aero Engines AG, Munich (DE)

(72) Inventors: Lothar Albers, Munich (DE); Georg Zotz, Haimhausen (DE); Vitalis Mairhanser, Sigmertshausen (DE)

(73) Assignee: MTU Aero Engines AG, Munich (DE)

( * ) Notice: Subject to any disclaimer, the term of this patent is extended or adjusted under 35 U.S.C. 154(b) by 216 days.

(21) Appl. No.: 15/365,506

(22) Filed: Nov. 30, 2016

(65) Prior Publication Data

US 2017/0159471 A1 Jun. 8, 2017

(30) Foreign Application Priority Data

Dec. 4, 2015 (EP) ..... 15198072

(51) Int. Cl.

| | |
|---|---|
| ***F01D 11/00*** | (2006.01) |
| ***F01D 17/16*** | (2006.01) |
| ***F01D 25/16*** | (2006.01) |
| ***F01D 9/04*** | (2006.01) |

(52) U.S. Cl.

CPC ..... *F01D 11/003* (2013.01); *F01D 9/041* (2013.01); *F01D 17/162* (2013.01); *F01D 25/162* (2013.01); *F05D 2220/32* (2013.01); *F05D 2240/55* (2013.01)

(58) Field of Classification Search

CPC .. F04D 27/002; F04D 27/0246; F04D 29/563; F01D 17/16; F01D 25/16; F01D 11/003; F01D 9/041; F01D 17/162; F01D 25/162; F01D 9/045; F05D 2220/32; F05D 2240/55; F05D 2240/90

USPC .... 415/159, 160, 161, 162, 230, 231, 168.1, 415/170.1, 173.7, 209.3, 209.4, 210.1

See application file for complete search history.

(56) References Cited

U.S. PATENT DOCUMENTS

| | | | | |
|---|---|---|---|---|
| 3,314,654 A | | 4/1967 | Thenault et al. | |
| 5,421,703 A | * | 6/1995 | Payling | F01D 9/042 415/209.3 |
| 7,125,222 B2 | * | 10/2006 | Cormier | F01D 17/162 415/160 |

(Continued)

FOREIGN PATENT DOCUMENTS

| | | | |
|---|---|---|---|
| DE | 102008032661 | A1 | 1/2010 |
| EP | 0146449 | A1 | 6/1985 |

(Continued)

*Primary Examiner* — David E Sosnowski
*Assistant Examiner* — Eric J Zamora Alvarez
(74) *Attorney, Agent, or Firm* — Barlow, Josephs & Holmes, Ltd.

(57) ABSTRACT

An inner ring according to the invention for a guide vane cascade of a turbomachine has a radially outer inner ring surface as well as a plurality of bearing mounts for a respective guide vane plate of a guide vane. The bearing mounts each have an opening in the outer inner ring surface as well as a bottom face lying radially opposite the opening. At least two of the bearing mounts are separated from each other by a separating wall and are connected to each other in a region of their bottom face by a through-opening. A guide vane cascade according to the invention for a turbomachine has an inner ring according to the invention and a plurality of guide vanes inserted into the bearing mounts.

9 Claims, 3 Drawing Sheets

(56) References Cited

U.S. PATENT DOCUMENTS

| | | | | |
|---|---|---|---|---|
| 2008/0219832 | A1* | 9/2008 | Major | F01D 17/162 415/65 |
| 2014/0140822 | A1* | 5/2014 | Capozzi | F01D 9/00 415/160 |
| 2015/0275916 | A1* | 10/2015 | Marshall | F01D 17/162 415/148 |
| 2016/0376916 | A1* | 12/2016 | Grothe | F01D 5/12 415/149.2 |
| 2017/0261003 | A1* | 9/2017 | Mouton | F01D 17/162 |

FOREIGN PATENT DOCUMENTS

| | | | |
|---|---|---|---|
| EP | 1760272 | A2 | 3/2007 |
| EP | 1967718 | A2 | 9/2008 |
| EP | 2520769 | A1 | 11/2012 |
| EP | 2696043 | A1 | 2/2014 |
| EP | 2725200 | A1 | 4/2014 |
| FR | 2994453 | A1 | 2/2014 |
| WO | 2010079204 | A1 | 7/2010 |
| WO | 2014078121 | A1 | 5/2014 |

* cited by examiner

INNER RING AND GUIDE VANE CASCADE FOR A TURBOMACHINE

BACKGROUND OF THE INVENTION

The invention relates to an inner ring for a guide vane cascade, an inner ring sector for an inner ring, a guide vane cascade having an inner ring and a plurality of guide vanes, as well as a turbomachine having a guide vane cascade.

Turbomachines, such as aircraft engines and stationary gas turbines, often have at least one compressor-side row of guide vanes having a plurality of guide vanes for the adjustment of optimal operating conditions. The row of guide vanes forms, together with an inner ring, a so-called guide vane cascade. Preferably, these guide vanes can pivot around their longitudinal axis.

The adjustable guide vanes can be actuated via radially outer-mounted adjusting pins of the guide vanes, the adjusting pins being able to interact with a corresponding adjusting device on the outer casing. A seal support, which is furnished with sealing elements or run-in coatings that lie opposite to rotor-side sealing ribs, is preferably carried on the inner ring.

The inner ring preferably has a plurality of bearing mounts extending in the radial direction, into each of which a guide vane plate of a guide vane is inserted or can be inserted. The radially inner end of a guide vane is stabilized by such a guide vane plate arranged in the bearing mount. In this case, the axis of rotation of the adjustable guide vane is perpendicular to the central axis of the guide vane cascade or the inner ring thereof. The guide vane plate can have a bearing journal on its radially inner side and the bearing mount can be arranged so as to accommodate this bearing journal together with an associated bushing.

The bearing mounts in the inner ring are separated from one another in the peripheral direction by respective separating walls extending in the axial direction. During manufacture of the inner ring as well as during operation of the guide vane cascade, there is the danger that such a separating wall will partially give way and thus be pressed into an adjacent bearing mount, which, as a result, would no longer retain its exact form; this can be prevented or at least impeded by a provided bearing mount of a guide vane plate and/or a pivoting of the guide vane. In operation, the separating wall can also be bent in the direction of an adjacent bearing mount and thus impair the ability of the guide vane inserted therein to pivot.

In order to minimize the danger of such a deformation of the bearing mounts, conventional inner rings are therefore fabricated with a minimum wall thickness for the separating walls, which the latter must have at their thinnest points.

For a given inner ring circumference, the number of bearing mounts for guide vane plates (and hence the number of mountable guide vanes) is determined by the given blade plate sizes as well as the minimum wall thickness that is to be maintained. These parameters accordingly act to limit the design of a turbomachine having a large number of pivotable guide vanes or large guide vane plates. However, such a design and/or a minimum size of the guide vane plate are or is often advantageous in terms of aerodynamics and/or structural mechanics.

The publication WO 2014/078 121 A1 discloses an arrangement in which the bearing mounts are not separated from one another by separating walls, but instead the depressions for the guide vane plates are arranged at a radially outer inner ring surface so as to transition into one another.

This has the drawback of increased leakage between the bearing mounts for the guide vane plates and all the way through them. In addition, a centering of the guide vane plates can be unstable in such an arrangement.

SUMMARY OF THE INVENTION

The object of the present invention is to provide an inner ring or an inner ring sector or a guide vane cascade or a turbomachine with stable centering and low leakage, wherein, for a given circumference, the guide vane cascade has an improved design in terms of aerodynamics and/or structural mechanics.

The object is achieved by an inner ring, by an inner ring sector, by a guide vane cascade, and by a turbomachine in accordance with the present invention. Advantageous embodiments are disclosed in the description, and the figures herein.

An inner ring according to the invention for a guide vane cascade of a turbomachine has a radially outer inner ring surface as well as a plurality of bearing mounts for a respective guide vane plate of a (preferably pivotable) guide vane; in this specification, the terms "radially" and "axially" always refer, unless stated otherwise, to a central geometric axis of the inner ring, even though, for better readability, this is not always again formulated; the same applies to the term "direction of rotation." The bearing mounts each have an opening in the radially outer inner ring surface as well as (at least) one bottom face lying radially opposite to the opening. At least two of the bearing mounts are separated from each other (in the direction of rotation) by a separating wall and are connected by a through-opening in a region of the bottom faces of the bearing mounts; the at least two bearing mounts are preferably arranged adjacently in the direction of rotation of the inner ring.

The at least one bottom face of a bearing mount of an inner ring according to the invention thus lies radially further inside than the radially outer inner ring surface and radially faces the surroundings of the inner ring through the opening. When the guide vane plate is not inserted, the bottom face is thus visible from the outside when viewed in the radial direction (inward). In particular, such a bottom face can form a stop for a guide vane plate that is to be inserted in the radial direction into the bearing mount.

The bearing mounts can each be arranged so as to accommodate an inserted guide vane plate with a bearing journal that is, if appropriate, arranged thereon and, in addition, possibly a bearing bushing for such a bearing journal. The at least one bottom face can form a stop surface for the bearing journal or for a bearing bushing that is to be inserted radially into the bearing mount for the bearing journal, or a further opening of a depression can be formed in the at least one bottom face and/or can be delimited by it (at least in part), said opening being arranged, for example, to accommodate a bearing journal of the guide vane plate.

An inner ring sector according to the invention (which can be of designed, for example, as a half, third, or quarter ring) is arranged to be assembled together with at least one further inner ring sector to form an inner ring according to the invention in accordance with one of the embodiments disclosed in this specification. It comprises at least two bearing mounts of the inner ring (assembled together according to the invention) that are separated from each other by a separating wall and connected to each other by a through-opening in a region of their bottom face.

A guide vane cascade according to the invention for a turbomachine has an inner ring according to one of the embodiments disclosed in this specification, as well as a plurality of guide vanes that are inserted into the bearing mounts.

A turbomachine according to the invention comprises a guide vane cascade according to the invention.

An inner ring according to the invention, an inner ring sector according to the invention, a guide vane cascade according to the invention, and a turbomachine according to the invention make possible in each case a secure, stable centering of the guide vane plate in its respective bearing mount with minimized leakage.

Moreover, they advantageously make possible an arrangement of guide vanes in which a distance between adjacent guide vane plates or bearing bushings is minimized, and at the same time, the danger of any deformation of a bearing mount can be prevented: This is because, especially when two adjacent bearing mounts have sections shaped as circular cylinders, they approach each other radially inward. In the region of their bottom faces, therefore, they have a smallest distance from each other. According to the present invention, then, it is not necessary to maintain a minimum distance in this region so as to prevent a separating wall that is too thin from being deformed unfavorably in this region: According to the invention, a through-opening between the bearing mounts exists in this narrowest region, so that a separating wall, which could be deformed, is not present there. By contrast, the bearing mounts are separated from one another by a separating wall further outward radially, where the circular-cylinder shaped sections of the bearing mounts lie further apart; this makes possible a secure and stable bearing of inserted guide vanes or bearing bushings for guide vanes.

In particular, such an inner ring makes possible an improvement in the efficiency and durability of a turbomachine.

Preferably, the at least two bearing mounts each comprise an essentially circular-cylindrical section (for example, a circular-cylindrical bore) in the inner ring, which extends radially in relation to the inner ring. Such bearing mounts can accommodate correspondingly shaped guide vane plates or bearing bushings with a circular-cylindrical segment, which makes possible an especially secure and stable bearing and pivotability of the guide vanes.

According to an advantageous embodiment, the at least two bearing mounts are separated from each other (in the peripheral direction), along the radially outer inner ring surface (at its narrowest points or at one of its narrowest points), by at most 3 mm, more preferably at most 2 mm.

As a result, a large number of guide vanes of a respectively advantageous guide vane plate size can be inserted into the bearing mounts, and the separating wall is thick enough so as not to be deformed.

Advantageous is an embodiment variant in which the separating wall between the at least two bearing mounts of the radially outer inner ring surface radially extends at least 2 mm, more preferably at least 3 mm into the inner ring.

According to an advantageous embodiment, the through-opening between the at least two bearing mounts has a radial height of at least 2 mm, more preferably at least 3 mm; in this case, the radial height is to be measured radially outward starting from the bottom face (or from one of the bottom faces, if several are present).

Thus, for example, in the case of bearing mounts with a circular-cylindrical segment and therefore a separating wall that tapers from the outside inward, a minimum thickness of the separating wall is ensured by limiting the radial extension of the separating wall inward (and hence its taper) by way of the through-opening.

In the axial direction (in relation to a central inner ring axis), the through-opening preferably has a width of at least 3 mm, more preferably at least 4 mm. In this way, it is possible to prevent an unfavorably small separating wall thickness lateral to a center of the through-opening (for example, in the narrowest region lying between two bearing mounts).

The through-opening can have a cross section the form of which is essentially a triangle, a circular segment, or a round or pointed arch in the direction of rotation (in relation to the inner ring). As a result, the through-opening can be optimized, regardless of the shape of the inner ring, in terms of its size and/or its surface design, for example. A triangular cross section can be produced especially simply in the case of an axially bisected inner ring, for example, because, to do this, the separating wall only needs to be beveled at the partial rings that are to be assembled together in each case. This applies analogously to a cross section in the form of a pointed arch. In the case of an axially undivided inner ring, the production of a cross section the form of which is a circle or round arch, can be associated with little expenditure. In addition, the avoidance of a central apex, which is associated with such cross sections, advantageously reduces any leakage in this region.

According to an advantageous embodiment, an inner ring according to the invention comprises two inner ring portions (for example, partial rings) assembled together in the axial direction, each of which has a rim in the axial direction that delimits in segments the plurality of bearing mounts. Accordingly, the bearing mounts are arranged between the inner ring portions, which together create at least one part of a support for each bearing mount in each case.

Such bisected inner rings are especially appropriate for the insertion of guide vanes and, in addition, can be produced with relatively little expenditure. In particular, they simplify the creation of the through-opening in a separating wall of an inner ring according to the invention, because the latter is especially readily accessible when the inner ring portions have not yet been assembled together.

Of the two inner ring portions, a first inner ring portion (for example, the back one in the primary flow direction) can have a projection with a surface, said projection extending in the axial direction on a side facing the second inner ring portion (for example, the front one in the primary flow direction), and preferably forming the bottom face for the bearing mounts, wherein the projection engages at an outer edge in an annular groove of the second ring portion that extends in the axial direction.

The at least two bearing mounts of an inner ring according to the invention, which are connected by the through-opening, are preferably designed in such a way that at least two of the inserted guide vanes are separated in the region of the through-opening (for example, in the region of the bottom faces) by a distance (at their narrowest point or at one of their narrowest points) of at most 0.5 mm (in the direction of rotation). It is advantageous when the guide vanes are inserted without contact in the region mentioned, being separated by a distance of at least 0.1 mm, for example.

In accordance therewith, at least two guide vanes (or their associated guide vane plates) of a guide vane cascade according to the invention, inserted into respective bearing mounts, are preferably separated in the region of the through-opening by a distance of at most 0.5 mm, more preferably in a range between 0.1 mm and 0.5 mm.

As a result of this, the guide vanes according to the invention can be arranged so tightly together that a large number of guide vanes having a suitable guide vane plate size can be inserted into the inner ring. The advantageous minimum distance of 0.1 mm mentioned prevents any contact of the guide vane plates, as a result of which, otherwise, an insertion could be impeded and/or a pivoting of the guide vanes during use could be impaired.

In embodiments in which the guide vanes have bearing journals, which are inserted into bearing bushings and will be or are inserted together with them into bearing mounts, the bearing bushings analogously have a separating distance in the region of the through-opening (in the direction of rotation) of preferably at most 0.5 mm, more preferably in a range between 0.1 mm and 0.5 mm. Alternatively or additionally, the radial height of the through-opening in embodiments with (optionally provided) bearing bushings is preferably at most as large as a liner height or thickness of the bearing bushings (that is, at least as great as the extension of the inserted bearing bushings in the radial direction—in relation to the inner ring). Such a height limitation of the through-opening minimizes any leakage at the radially outer side of the bearing bushings.

BRIEF DESCRIPTION OF THE DRAWING FIGURES

In the following, preferred exemplary embodiments of the invention will be explained in detail on the basis of drawings. It is self-evident that individual elements and components can also be combined differently from the illustrations. Reference numbers for elements that correspond to each other are used across the figures and, optionally, are not described anew for each figure.

Shown schematically are:

DESCRIPTION OF THE INVENTION

Figure 1:
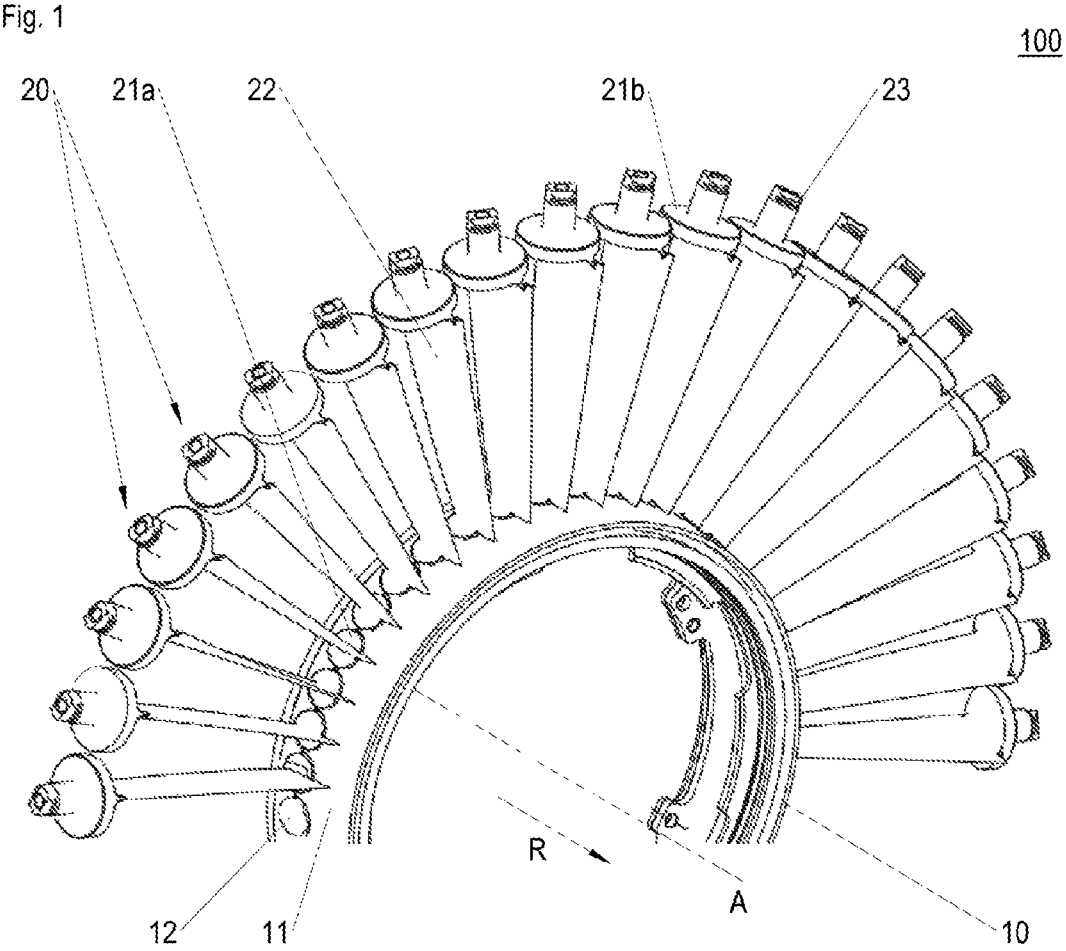
FIG. 1 shows a section of a guide vane cascade in perspective illustration.

FIG. 1 shows, in perspective illustration, a section of a guide vane cascade 100. It comprises an inner ring 10 with a radially outer inner ring surface 11 and a plurality of bearing mounts 12, into each of which a guide vane plate 21*a* of a guide vane 20 is inserted; for better understanding, a bearing mount without an inserted guide vane is shown at the edge of the illustration. An intended primary flow direction R runs axially from the figure background all the way through the inner ring 10 into the foreground of the figure; the adverb "axially" (likewise the adverb "radially") is to be understood in this case in relation to an (abstract) central axis A of the inner ring 10 (and hence of the guide vane cascade 100).

The guide vanes 20 comprise, besides the radially inward positioned guide vane plate 21*a*, a radially outward positioned guide vane plate 21*b*, which is provided for fixation at a casing (not shown). Arranged between the guide vane plates 21*a* and 21*b* is a vane element 22. The radially outward positioned guide vane plates 21*b* have a radially outward extending adjusting pin 23 on the side facing away from the vane element 22.

Not visible in the illustration of FIG. 1 is that, in each case, a bottom face 14 lies radially opposite to the openings of the bearing mounts 12 on the inner ring surface 11 according to the invention, in the region of which at least two of the bearing mounts 12 are connected to each other by a through-opening 16. This is made clear in the sectional illustration of FIG. 2.

Figure 2:
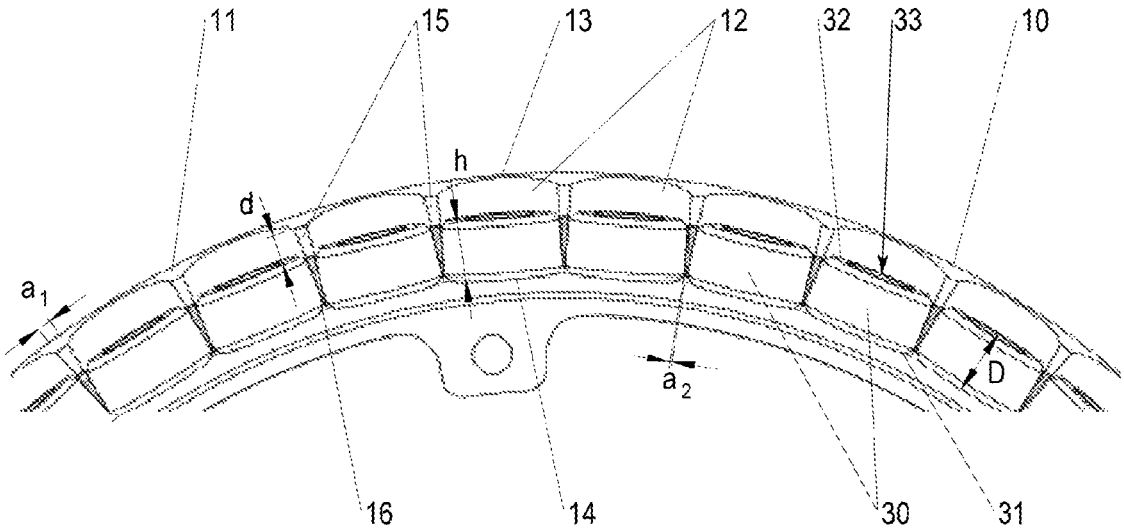
FIG. 2 shows a section of an exemplary inner ring according to the invention with inserted bearing bushings in a sectional illustration.

FIG. 2 shows a section of an inner ring 10 with an inner ring surface 11 and a plurality of bearing mounts 12 for guide vane plates (not shown). A bearing bushing 30 has a radially inner annular face 31, a radially outer annular face 32, and a radially extending bore 33, which connects the two annular faces 31 and 32 to each other. The bearing bushings 30 for the bearing journals (not shown) of the respective guide vane plates are inserted into the bearing mounts 12 in the example illustrated. The radially inner annular face 31 of the bearing bushing 30 lies on the radially outward directed bottom face 14.

Figure 5A:
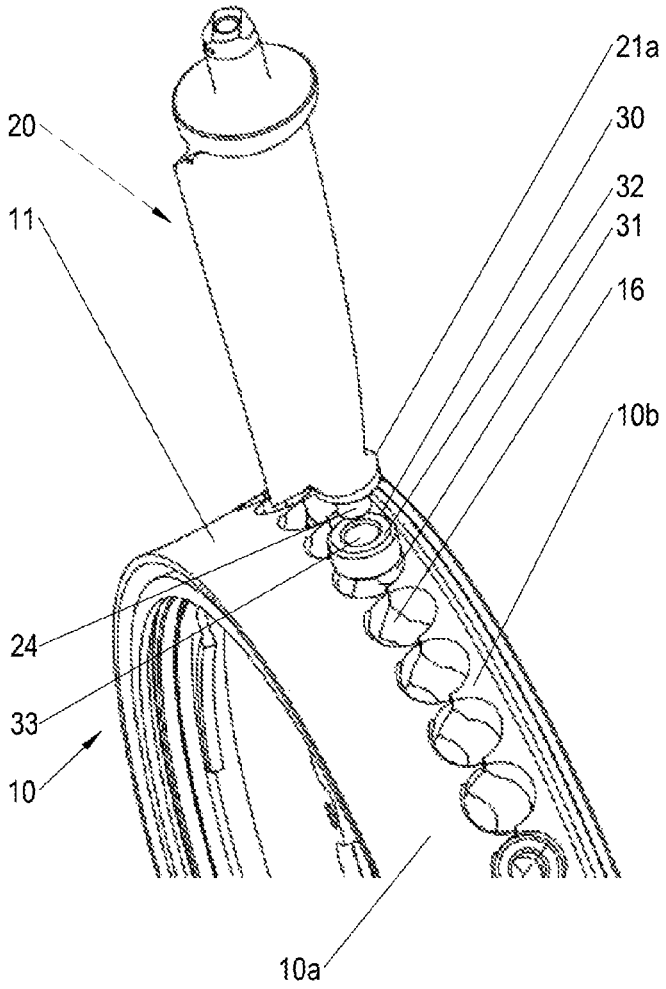
FIGS. 5*a*, 5*b*, in each, show an exploded illustration of an exemplary inner ring according to the invention with bearing bushing and guide vane.
Figure 5B:
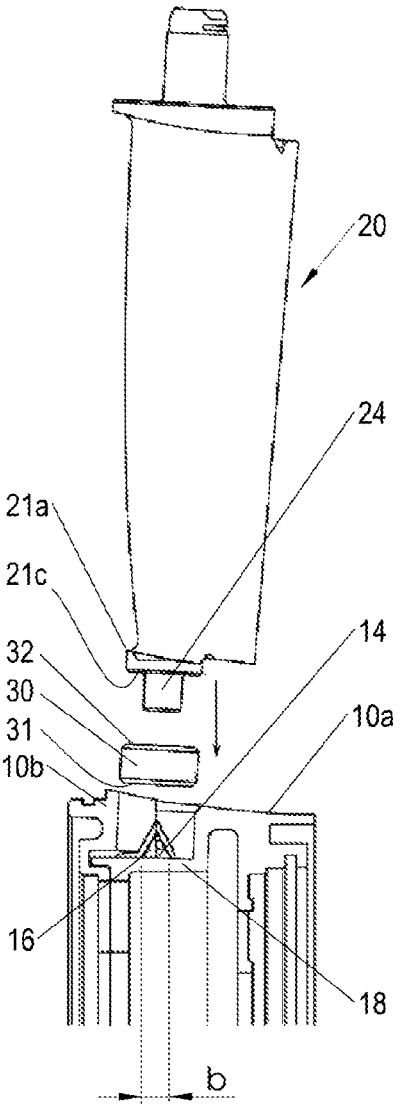

The bearing journal 24, molded on the radially inner face 21*c* of the guide vane plate 21*a*, is later arranged in the bore 33, so that the inner face 21*c* rests on the radially outer annular face 32 of the bearing bushing 30; this is illustrated in FIGS. 5*a*, 5*b*.

The bearing mounts 12 each have an opening 13 at the inner ring surface 11 as well as a bottom face 14, which lies radially opposite to the opening (in relation to the inner ring axis); when the guide vane plate is not inserted, therefore, the bottom face is visible when viewed from the outside in the radial direction of view. In the illustrated example, the bottom faces 14 each form stop surfaces for the bearing bushings 30. The bottom faces 14 can close off the bearing mounts 12 radially inward in full or only in part; in particular, they, in turn, can have openings (not shown).

A separating wall 15, which separates the bearing mounts from each other, is arranged between every two adjacent bearing mounts 12; an extension d of the separating wall in the radial direction (in relation to the inner ring) (starting from the inner ring surface) is preferably at least 2 mm, more preferably at least 3 mm. In particular, the extension d is preferably at least as great as the thickness (that is, linear height) of an inserted guide vane plate (measured without bearing journal), so that, in the inserted state, it does not protrude from the inner ring surface 11.

In a region of their bottom face, adjacent bearing mounts 12 are each connected to one another by a through-opening 16.

These through-openings 16 make possible an advantageous arrangement of the bearing bushings (or guide vane plates—not shown in FIG. 2—to be inserted into the bearing mounts 12), with the avoidance of an unfavorably thin region of the separating wall. As can be seen in FIG. 2, the cylindrically shaped bearing mounts are arranged radially in the inner ring. The distance between every two adjacent bearing mounts thus decreases continuously radially inward. The separating distance in the radially outer region (at the inner ring surface 11) is indicated in the figure by $a_1$, the separating distance in the radially inner region (at the bottom face 14) by $a_2$; as can be seen in the figure, $a_1 > a_2$. Preferably, $a_1$ is at most 3 mm, more preferably at most 2 mm. The distance $a_2$ is advantageously less than or equal to 0.5 mm; more preferably it is between 0.1 mm and 0.5 mm.

Even for such a tight arrangement of the bearing mounts, it is possible to avoid a correspondingly thin and hence deformation-prone separating wall in accordance with the invention by arranging the through-opening 16 in the corresponding region. The radial height h thereof (starting from an abutting bottom face 14) is preferably at least 2 mm, more preferably at least 3 mm.

The radial height of the through-opening is preferably less than or equal to a thickness D of the bearing bushings 30 (that is, their radial extension in relation to the inner ring in the inserted state); it is possible in this way to prevent or at least to minimize any leakage at a radially outer surface of the bearing bushings and all the way through the through-opening.

Figure 3:
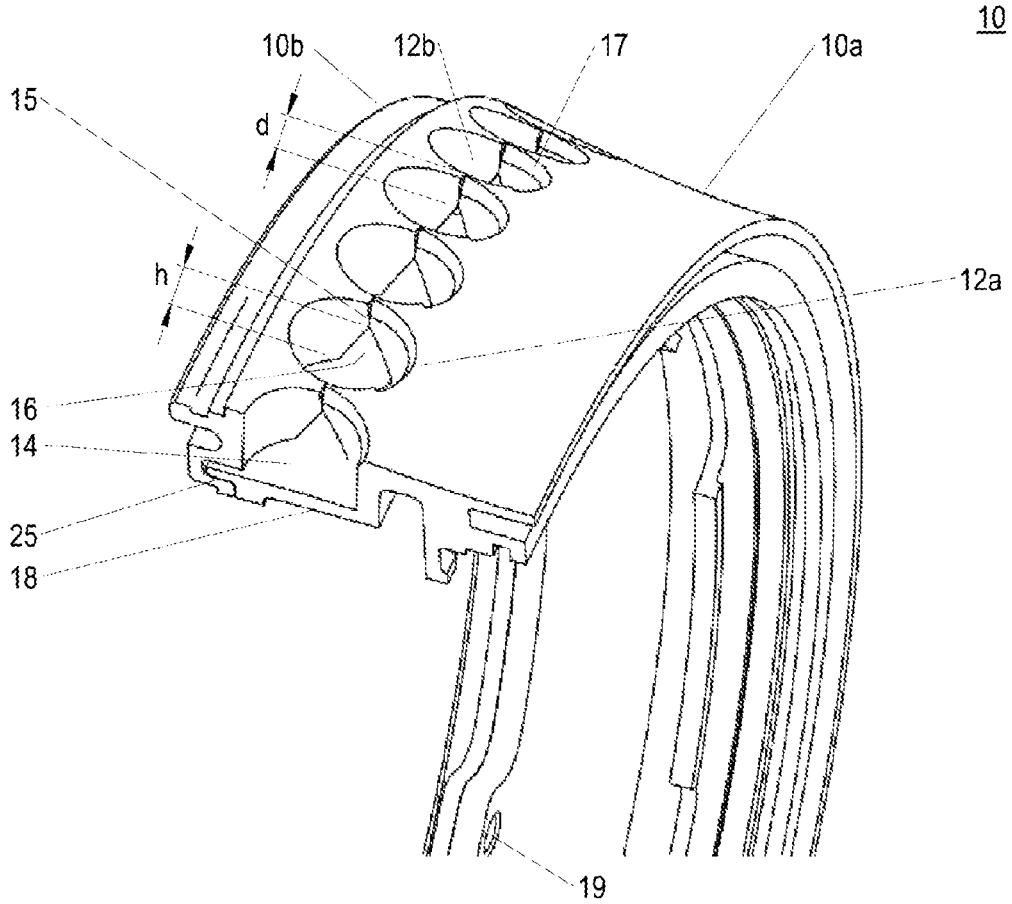
FIG. 3 shows a section of an inner ring according to an exemplary embodiment of the present invention.
Figure 4:
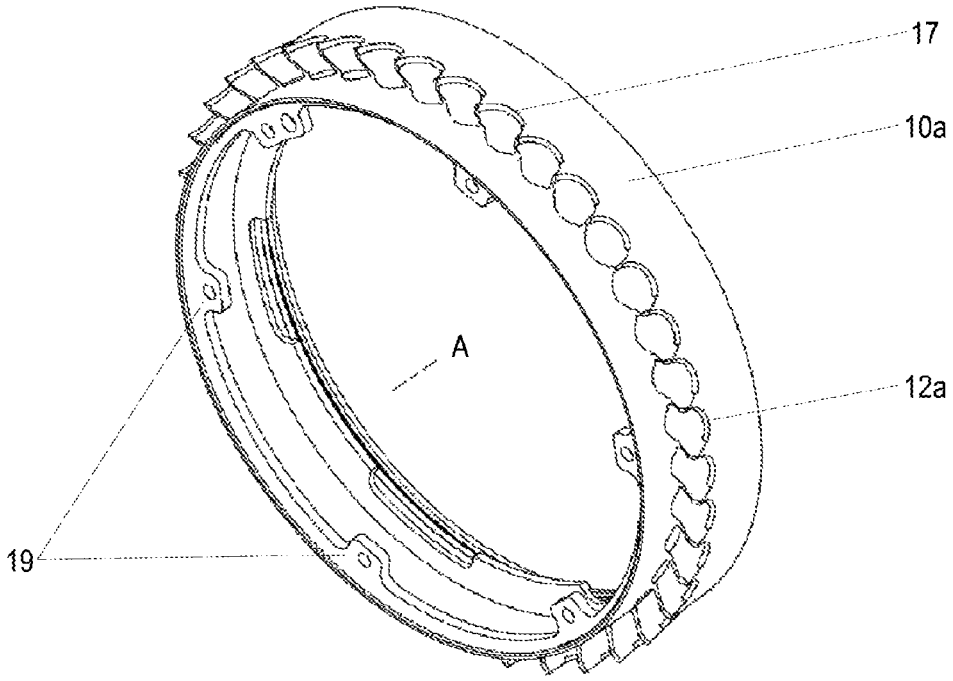
FIG. 4 shows a section of a back portion of an exemplary inner ring according to the invention.

Illustrated in FIG. 3 is a section of an axially bisected inner ring 10 according to the invention. The inner ring 10 comprises a front inner ring portion 10*b* (in the intended primary flow direction) and a back inner ring portion 10*a* (in the intended primary flow direction); this is additionally illustrated in FIG. 4 in another view. The inner ring portions 10*a* and 10*b* are each formed as partial rings, that is, in particular, also as rings.

The front and back inner ring portions each have a rim 12*b* or 12*a*, which together support a plurality of bearing mounts and, in each case, form a section of their borders.

In the example shown, the rim 12*a* of the back inner ring portion 10*a* has a bevel 17 in the border section of each bearing mount; it makes possible a pivotable guide vane that is carried on the inner ring in a correspondingly tight manner.

On the side facing the front inner ring portion, the back inner ring portion 10*a* has a projection 18 extending in the axial direction, which engages at an outer rim in an annular groove 25 of the front inner ring portion 10*b* that extends in the axial direction, and has a surface, which forms, in each case, a bottom face 14 for the bearing mounts. In this case, the bottom faces 14 lie radially opposite the openings 13 of the bearing mounts 12. The bottom face 14 thereby forms the radially outward directed face of the projection 18.

Adjacent bearing mounts are each separated from one another in the region of the openings of the bearing mounts (in the inner ring surface) by a separating wall 15, which has a radial height d. In the region of the bottom faces 14, adjacent bearing mounts are each connected by a through-opening 16. In this case, the through-openings have a radial height h, which preferably lies in a range of 2 mm to 3 mm. In the example illustrated, the through-opening has a triangular cross section. As described above, other cross-sectional shapes are possible, such as, for example, a circular segment shape or a round- or pointed-arch shape. In particular, the through-opening can be optimized, independently of the shape of the inner ring, in terms of its size and/or its surface design, for example.

In the embodiment shown, the front and the back inner ring portions can be connected to each other via connecting elements 19.

FIGS. 5*a* and 5*b* each show, in different perspectives in an exploded illustration, an inner ring 10 according to an embodiment of the present invention with a guide vane 20 to be inserted. For an explanation of the individual elements identified in analogy to the above figures, reference is made to the description thereof. As further marked in FIG. 5*b*, the through-opening 16 has, in the axial direction (in relation to a central inner ring axis that is not shown), a width b in the region of the bottom face 14 formed by the projection 18; preferably, this width b is at least 3 mm, more preferably at least 4 mm. It is possible in this way to prevent the separating wall thickness from being too small even laterally of a center of the through-opening (for example, a center lying in the narrowest region lying between two bearing mounts).

An inner ring 10 according to the invention for a guide vane cascade of a turbomachine has a radially outer inner ring surface 11 as well as a plurality of bearing mounts 12 for, in each case, a guide vane plate 21*a* of a guide vane 20. The bearing mounts 12 each have an opening 13 in the outer inner ring surface 11 as well as a bottom face 14 lying radially opposite to the opening. At least two of the bearing mounts 12 are separated from each other by a separating wall 15 and are connected to each other in a region of their bottom face 14 by a through-opening 16.

A guide vane cascade 100 according to the invention for a turbomachine has an inner ring 10 according to the invention and a plurality of guide vanes 20 inserted into the bearing mounts 12.

What is claimed is:

1. An inner ring for a guide vane cascade of a turbomachine, wherein the inner ring has a radially outer inner ring surface as well as a plurality of bearing mounts for a respective guide vane plate of a guide vane;

wherein the plurality of bearing mounts each have an opening in the outer inner ring surface as well as a bottom face lying radially opposite the opening;

wherein at least two of the plurality of bearing mounts are separated from each other by a separating wall and are connected to each other in a region of their bottom face by a through-opening, wherein each of the through-openings extend circumferentially, about the inner ring, through the separating wall from one bearing mount to another bearing mount, of the at least two bearing mounts, and wherein each of the through-openings have, in a direction of rotation of the inner ring, a cross section that has a triangle shape.

2. The inner ring according to claim 1, wherein the plurality of bearing mounts each comprise a cylindrical bore in the inner ring, which extends radially in relation to the inner ring.

3. The inner ring according to claim 1, wherein the at least two bearing mounts have a separating distance from each other along the radially outer inner ring surface of at most 2 mm.

4. The inner ring according to claim 1, wherein the separating wall between the at least two bearing mounts extends radially from the radially outer inner ring surface into the inner ring by up to 3 mm; and wherein the through-opening between the at least two bearing mounts, starting from the bottom face of one of the bearing mounts, has a radial height of at least 3 mm.

5. The inner ring according to claim 1, comprising two inner ring portions assembled together in an axial direction, each of which has a rim in the axial direction, which delimits sections of the plurality of bearing mounts.

6. The inner ring according to claim 5, wherein, of the two inner ring portions, a first inner ring portion has a projection with a surface extending in the axial direction on a side facing a second inner ring portion, said projection forming the bottom face for the plurality of bearing mounts, wherein the projection engages at an outer rim in an annular groove of the second inner ring portion extending in the axial direction.

7. The inner ring according to claim 1, wherein plurality of guide vanes, each guide vane inserted into a respective bearing mounts, are configured into a guide vane cascade.

8. The inner ring according to claim 7, wherein at least two of the plurality of guide vanes or at least two bearing bushings inserted in the at least two of the plurality of bearing mounts for the guide vanes have a separating distance of at most 0.5 mm.

9. The inner ring according to claim 7, wherein the guide vane cascade is configured into a turbomachine.

* * * * *